US007793685B2

(12) United States Patent
Desbiolles et al.

(10) Patent No.: US 7,793,685 B2
(45) Date of Patent: Sep. 14, 2010

(54) CONTROLLING GAS PARTIAL PRESSURES FOR PROCESS OPTIMIZATION

(75) Inventors: Jean-Pierre Desbiolles, Cruseilles (FR); Michel Puech, Metz-Tessy (FR)

(73) Assignee: Alcatel, Paris (FR)

( * ) Notice: Subject to any disclaimer, the term of this patent is extended or adjusted under 35 U.S.C. 154(b) by 897 days.

(21) Appl. No.: 11/291,962

(22) Filed: Dec. 2, 2005

(65) Prior Publication Data

US 2006/0118178 A1 Jun. 8, 2006

(30) Foreign Application Priority Data

Dec. 3, 2004 (FR) ..... 04 52853

(51) Int. Cl.
*F04B 3/00* (2006.01)
*F04B 23/08* (2006.01)
*F04B 49/06* (2006.01)

(52) U.S. Cl. ..... 137/565.23; 137/565.3; 137/613; 417/205; 417/286

(58) Field of Classification Search ..... 137/487.5, 137/565.3, 565.23, 565.13, 613; 417/244, 417/279, 286, 53, 203, 205
See application file for complete search history.

(56) References Cited

U.S. PATENT DOCUMENTS 4,529,860 A * 7/1985 Robb ..... 219/121.41
4,699,570 A 10/1987 Bohn et al.
5,352,656 A * 10/1994 Lackey et al. ..... 505/434
5,628,364 A * 5/1997 Trenz ..... 166/53
5,746,581 A * 5/1998 Okumura et al. ..... 417/2
5,944,049 A 8/1999 Beyer
5,979,225 A * 11/1999 Zhou ..... 73/40.7
6,314,794 B1 * 11/2001 Seigeot ..... 73/40.7
6,782,907 B2 * 8/2004 Kawasaki et al. ..... 137/12
7,253,107 B2 * 8/2007 Snijders ..... 438/680
2007/0028669 A1 * 2/2007 Brewster ..... 73/31.03

FOREIGN PATENT DOCUMENTS

DE 100 43 783 A1 3/2002
EP 1 081 380 A1 3/2001
EP 1475535 A1 * 11/2004
FR 2 854 667 A1 11/2004

* cited by examiner

*Primary Examiner*—Stephen Hepperle
*Assistant Examiner*—Atif H Chaudry
(74) *Attorney, Agent, or Firm*—Carmen Patti Law Group, LLC

(57) ABSTRACT

Apparatus for establishing and controlling a low pressure gas mixture in a vacuum enclosure (8) comprises at least one secondary pump (9) of the molecular, turbomolecular, or hybrid type, followed by at least one primary pump (10), with first control and adjustment means (22) such as a regulation valve (24) for controlling and adjusting the total gas pressure of the mixture of gases in the vacuum enclosure (8) as a function of a total pressure setpoint (27). The apparatus further comprises second control and adjustment means (28) such as a second regulation valve (29*a*) downstream from the secondary pump (9). The second regulation valve (29*a*) is controlled as a function of a delivery pressure setpoint (32) to modify the delivery pressure of the secondary pump (9) and thus to adapt its pumping capacity in selective manner. This makes it possible to adjust the proportions of the gases in the mixture of gases in the vacuum enclosure, independently of the total pressure which is controlled by the first regulation valve (24).

20 Claims, 4 Drawing Sheets

CONTROLLING GAS PARTIAL PRESSURES FOR PROCESS OPTIMIZATION

The present invention relates to controlling the atmosphere in a vacuum enclosure such as a process chamber used in the fabrication of semiconductors.

The processes implemented in vacuum enclosures for fabricating semiconductors require a low pressure atmosphere to be established and controlled, which atmosphere is generally constituted by a mixture of gases.

In the mixture of gases, there are active gases for reacting on substrates present in the vacuum enclosure, and there are gases that are the result of the reaction. It is therefore necessary to pump the atmosphere out from the vacuum enclosure continuously in order to evacuate the reaction gases, and to insert active gases into the vacuum enclosure continuously in order to continue with the reactions.

The reactions are generally produced in a plasma, and they require the overall gas pressure in the vacuum enclosure to be controlled continuously. Thus, the overall gas pressure is an important parameter in such processes, and it is commonly controlled by using control and adjustment means adapted to control and adjust the overall pressure of the gas mixture in the vacuum enclosure.

To pump gas out from the vacuum enclosure, use is generally made of at least one secondary pump that is adapted to the low pressures that are to be obtained, together with at least one primary pump adapted to deliver to atmospheric pressure, a first pipe having an inlet connected to an outlet of the vacuum enclosure and having an outlet connected to a suction inlet of the secondary pump, and an intermediate pipe having an inlet connected to a delivery outlet from the secondary pump and an outlet connected to a suction inlet of the primary pump. That disposition is made necessary by the fact that the atmosphere in the vacuum enclosure is at very low pressure, and pump technologies generally require a secondary pump to be put in series with a primary pump.

Nevertheless, known devices present drawbacks, because the proportions of the gases present in a vacuum enclosure such as a process chamber are not under control. For example, in an aluminum etching process, the injected gases are cracked by a plasma and then they react with the various materials present on the substrate. The concentrations of gaseous residues depend directly on the way in which the secondary pump pumps the various species, and in certain circumstances this can be non-optimum for the process. Depending on the masses and the sizes of the gas molecules present in the mixture, the secondary pump may evacuate as a priority the active gases that are used for performing the process, while leaving behind in the vacuum enclosure the inactive gases that result from the active gases reacting with the materials and that are therefore not useful for performing the process. It will be understood that that can have the effect of slowing down or even degrading the performance of the process.

There is therefore a need to encourage the evacuation of the inactive gases from vacuum enclosures such as process chambers while avoiding as much as possible evacuating the active gases that have not yet reacted.

The means for controlling and regulating the overall gas pressure in a vacuum enclosure generally comprise various means such as injecting gas into the vacuum enclosure, and a regulation valve placed in the first pipe upstream from the secondary pump, i.e. at the outlet from the vacuum enclosure. Such a regulation valve tends to encourage the pumping of light gases, which are generally the active gases, and tend to slow down the evacuation of heavy gases such as the gases that stem from the reactions. That is therefore unfavorable to the desired objective.

To avoid that, document U.S. Pat. No. 6,200,107 proposes displacing the regulation valve and placing it in a bypass pipe connected in parallel around the secondary pump between the first pipe and the intermediate pipe. According to that document, the regulation valve thus constitutes the only means for regulating the pressure in a process chamber, and it encourages the evacuation of the inactive gases that result from the reactions in the chamber.

That same document clearly dissuades against using a regulation valve upstream from the secondary pump, or a regulation valve downstream from the secondary pump, or an injection of gas into the intermediate pipe, or even a variation in the speed of rotation of the primary pump.

The solution proposed in that document does not give satisfaction because an action on a regulation valve placed in the bypass pipe necessarily produces both a variation in the overall pressure in the vacuum enclosure and a modification in the proportions of the gases in the vacuum enclosure. It is then not possible to optimize a process by having complete control both over the overall gas pressure in the vacuum enclosure and over the proportions of the gases in the gaseous mixture in the vacuum enclosure.

That solution also presents the major drawback of polluting the process chamber in terms of particles since it reinjects gas that has passed through the secondary pump and that is therefore potentially loaded with particles.

The problem proposed by the present invention is to find another means for establishing and controlling a gaseous mixture at low pressure in a vacuum enclosure, making it possible simultaneously to control the overall gas pressure in the vacuum enclosure and also to control the proportions of the various gases in the gaseous mixture present in the vacuum enclosure.

The invention thus seeks to optimize the processes implemented in vacuum enclosures, such as semiconductor fabrication processes.

Another object of the invention is to avoid any risk of the device of the invention leading to additional pollution.

To do this, the present invention results from the observation whereby molecular, turbomolecular, or hybrid secondary pumps present a pumping capacity that varies as a function of the pump outlet pressure, and that this variation in pumping capacity is not identical for all gases. As a result, pumps perform selective pumping that can be modified by means of the outlet pressure.

Thus, the idea on which the invention is based is that by appropriately selecting the outlet pressure of the secondary pump, it is possible to act favorably on the partial pressures of the gases in the vacuum enclosure in order to control the parameters of a process.

Starting from this idea, the invention proposes apparatus for establishing and controlling an appropriate low pressure gas mixture in a vacuum enclosure, the apparatus comprising:

- at least one secondary pump of a molecular, turbomolecular, or hybrid type;
- at least one primary pump adapted to deliver to atmospheric pressure;
- a first pipe having an inlet connected to an outlet of the vacuum enclosure and an outlet connected to a suction inlet of the secondary pump;
- an intermediate pipe having an inlet connected to a delivery outlet of the secondary pump and an outlet connected to a suction inlet of the primary pump;

first control and adjustment means adapted to controlling and adjusting the total gas pressure of the mixture of gases in the vacuum enclosure as a function of a total pressure setpoint; and second control and adjustment means distinct from the first control and adjustment means, disposed downstream from the secondary pump, and acting on the delivery pressure from the secondary pump in the range of pressures in which changes of pressure lead to significant variations in the selective pumping speeds of different gases of the mixture, so as to adapt the pumping capacity of the secondary pump selectively, thereby adjusting the proportions of the gases in the mixture of gases in the vacuum enclosure.

Because first control and adjustment means that maintain the total gas pressure of the gaseous mixture in the vacuum enclosure on a continuous basis are combined with second control and adjustment means that adjust the proportions of the gas, full control is obtained over the atmosphere in the vacuum enclosure, thus making it possible in particular genuinely to optimize processes that are implemented in the vacuum enclosure.

Preferably, the first control and adjustment means are disposed upstream from the secondary pump, and comprise a regulation valve interposed in the first pipe and/or means for controlled injection of gas into the vacuum enclosure.

Preferably, in a first embodiment, the second control and adjustment means comprise a regulation valve interposed in the intermediate pipe.

In a second embodiment, the second control and adjustment means comprise a gas injection device for injecting an inert gas into the intermediate pipe.

In a third embodiment, the second control and adjustment means comprise speed control means for controlling the speed of the primary pump.

According to the invention, in the second control and adjustment means it is possible to combine a regulation valve and/or means for injecting gas and/or means for varying the speed of the primary pump.

In a first possibility, the apparatus can act in a closed loop as a function of information measured in the vacuum enclosure itself. To do this, the apparatus comprises:

partial pressure sensors suitable for determining the partial pressure(s) of one or more gases in the mixture of gases in the vacuum enclosure, and for producing partial pressure data; and a partial pressure controller, receiving the partial pressure data produced by the partial pressure sensors, comparing said data with partial pressure setpoints, searching for differences between the measured proportions of the gases and the proportions corresponding to the partial pressure setpoints, and generating an output signal controlling the second control and adjustment means to adapt the pumping capacity of the secondary pump selectively in the direction that reduces the difference between the measured proportions of the-gases and the proportions corresponding to the partial pressure setpoints.

In one possibility for this embodiment, the apparatus may be such that:

the partial pressure controller generates on its output a delivery pressure setpoint;

a delivery pressure sensor measures the delivery pressure in the intermediate pipe and generates delivery pressure measurement data; and a delivery pressure controller receives the delivery pressure setpoint and the delivery pressure data, and controls the delivery pressure regulation means to reduce the difference between the delivery pressure setpoint and the measured delivery pressure data.

In an alternative, the apparatus may operate in an open loop, e.g. receiving a setpoint coming from external control means managing the process being implemented in the vacuum enclosure.

In all cases, the apparatus of the invention may further comprise a control unit controlling the second control and adjustment means in application of a specific program for adapting the pumping capacity of the secondary pump selectively to the various successive steps of a treatment process taking place in the vacuum enclosure.

In another aspect, the invention provides a method of establishing and controlling an appropriate gaseous mixture at low pressure in a vacuum enclosure using apparatus as defined above. In the method, action is taken on the delivery pressure of the secondary pump to adapt its pumping capacity selectively, thereby adjusting the proportions of the gases in the gas mixture.

In a first implementation, action is taken on the delivery pressure by modifying the conduction of the intermediate pipe.

In a second implementation, action is taken on the delivery pressure by injecting an inert gas into the intermediate pipe.

In a third implementation, action is taken on the delivery pressure by modifying the speed of the primary pump.

In the invention, all three above methods of taking action can be combined together, or they can be combined in pairs.

In all cases, it is possible advantageously to act on the delivery pressure of the secondary pump as a function of successive steps in a treatment process taking place in the vacuum enclosure.

In one possible application, the method of the invention acts on the delivery pressure of the secondary pump in the direction appropriate for increasing the pumping of moisture during a process of controlled evacuation of the vacuum enclosure.

In another application, the method acts on the delivery pressure of the secondary pump in the direction appropriate for keeping the partial pressure of at least one gas in the vacuum enclosure constant.

The above-defined apparatus may find an application in compensating variations in the pumping characteristics of a secondary pump. These variations may occur over time due to deposits taking place in succession on the walls of the pump, or they may occur when one pump needs to be replaced by another.

A particularly advantageous application lies in preferentially evacuating heavy gases from dry etching process chambers in the fabrication of semiconductors or micro-electromechanical systems (MEMS). This makes it possible to increase etching speed significantly.

Another advantageous application can be controlling the quality of chemical vapor deposition (CVD) by acting on the delivery pressure of the secondary pump.

The apparatus may also find an application in compensating for drift in a system for pumping gas from a vacuum enclosure, where all kinds of drift can arise for reasons both known and unknown.

Other objects, characteristics, and advantages of the present invention appear from the following description of particular embodiments, made with reference to the accompanying figures, in which.

Figure 6:
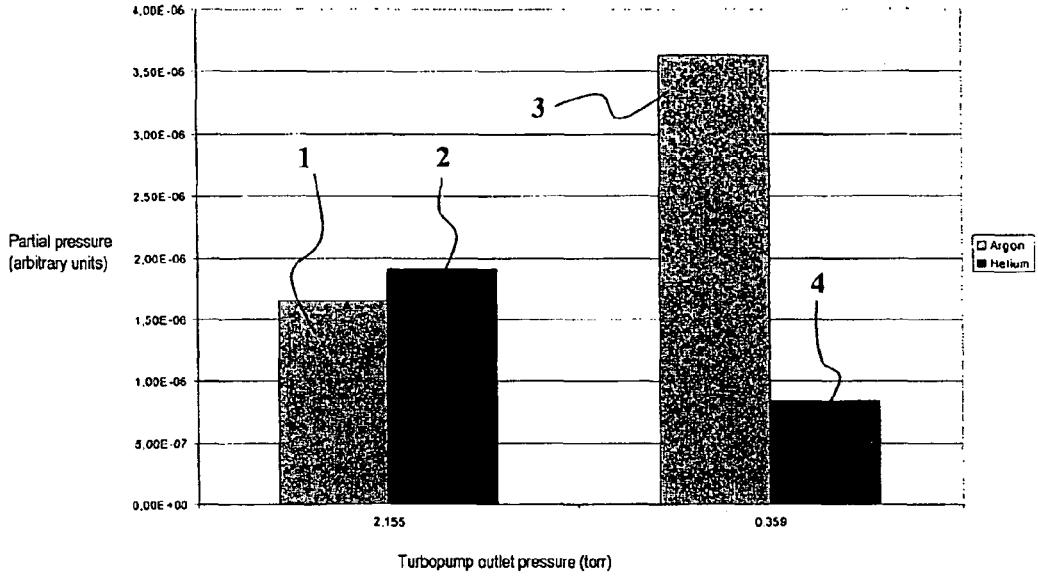
FIG. 6 shows the partial pressures of a mixture of two gases in a vacuum enclosure at constant total pressure for two different outlet pressures from the turbomolecular pump that pumps the gases.
Figure 7:
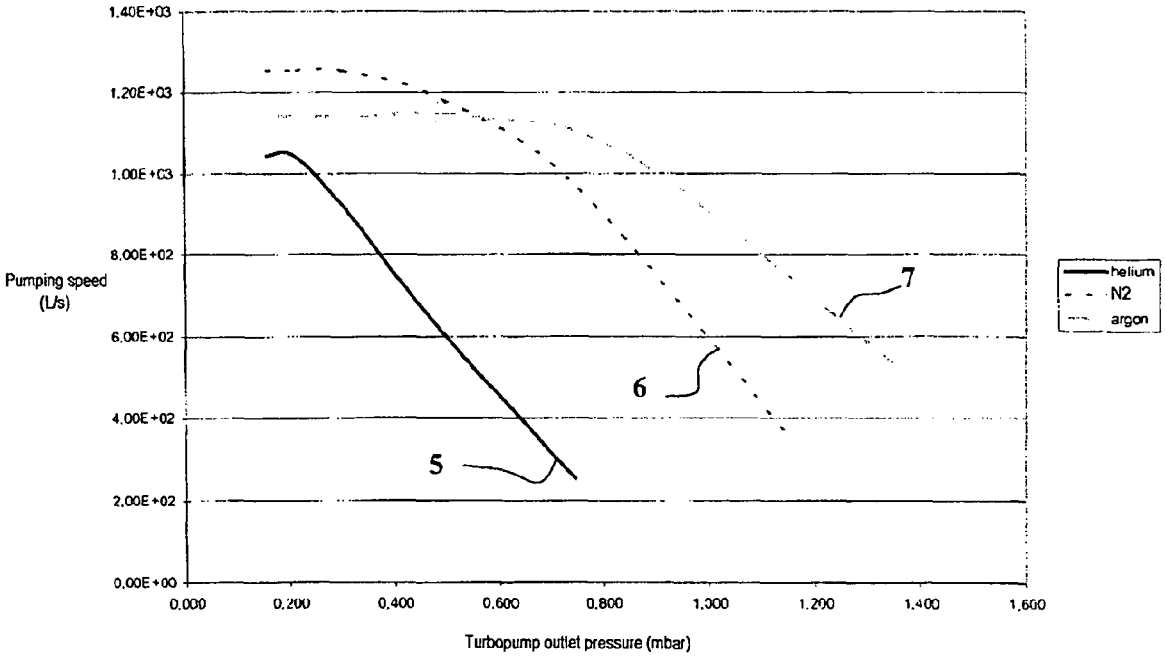
FIG. 7 plots curves showing variation in the pumping speeds of three different gases as a function of the outlet pressure from a turbomolecular pump.

Reference is made initially to FIGS. 6 and 7 which show the particular property of molecular, turbomolecular, or hybrid pumps on which the present invention is based.

FIG. 6 shows the partial pressures of a mixture of two gases at constant total pressure at the inlet to a turbomolecular pump, given in arbitrary units, for two different outlet pressures from the turbomolecular pump. The speed of the turbomolecular pump is constant.

Zone 1 shows the partial pressure of argon for an outlet pressure of 2.155 torr at the outlet of the turbomolecular pump, while zone 2 shows the partial pressure of helium under the same conditions, for a mixture of argon and helium at a given total pressure.

Zones 3 and 4 illustrate respectively, for a mixture of the same argon and helium gases at the same total pressure, the respective partial pressures of the argon and the helium when the outlet pressure from the turbomolecular pump is 0.359 torr.

It can be seen that for an outlet pressure of 2.155 torr, the partial pressure of argon is a little less than the partial pressure of helium. However, at an outlet pressure of 0.359 torr, the partial pressure of argon is much greater, whereas the partial pressure of helium is much smaller.

With reference to FIG. 7, curves 5, 6, and 7 relate respectively to helium, nitrogen, and argon gases and show respectively the pumping speeds in liters per second of helium, nitrogen, and argon as a function of the outlet pressure from a turbomolecular pump.

It can be seen that all three pumping speeds for the three gases, helium, nitrogen, and argon, decrease with increasing outlet pressure, but that the variations are different. For example, the argon pumping speed is relatively constant up to an outlet pressure of about 0.8 millibars (mbar) and decreases quite quickly above that. The pumping speed of nitrogen is relatively constant up to an outlet pressure of 0.4 mbar, and thereafter decreases more rapidly than does the pumping speed of argon. Finally, pumping speed of helium decreases very quickly as soon as the outlet pressure reaches 0.2 mbar.

Consequently, by fixing an outlet pressure of 0.6 mbar, for example, it can be seen that the pumping speeds of nitrogen and argon are substantially equal and relatively high while the pumping speed of helium is much lower. However, for an outlet pressure of about 0.2 mbar, the pumping speeds of all three gases are quite close to one another.

Thus, by modifying the outlet pressure from the turbomolecular pump, the pumping capacity of the pump can be modified in selective manner, in order to favor pumping one or other of the gases.

The present invention takes advantage of this phenomenon in order to improve establishing and controlling a mixture of gases at low pressure in a vacuum enclosure.

Figure 1:
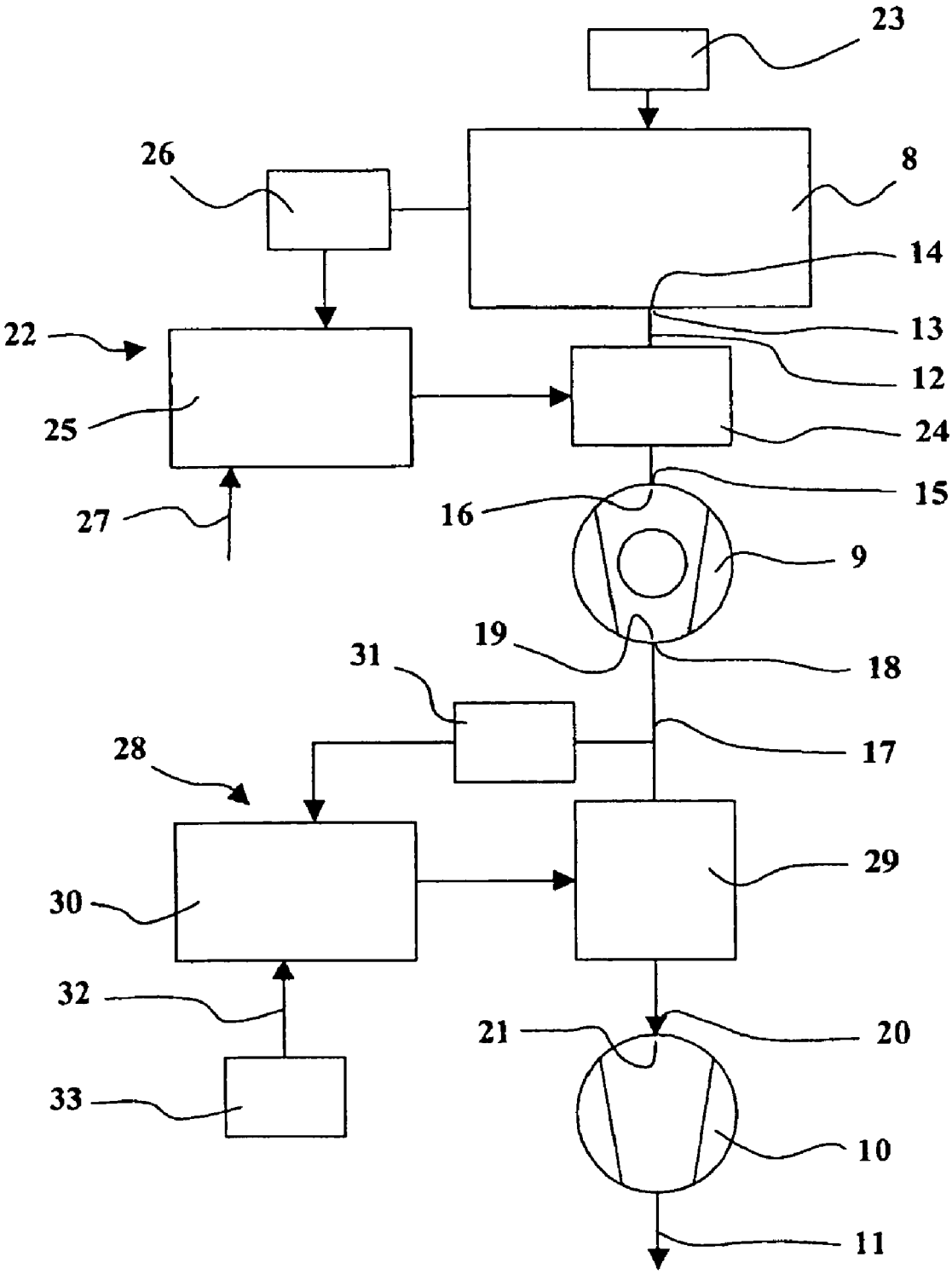
FIG. 1 is a diagram of apparatus in an embodiment of the present invention.

Reference is now made to FIG. 1 which shows a general structure for apparatus in an embodiment of the invention. The apparatus is for establishing and controlling an appropriate mixture of gases at low pressure in a vacuum enclosure 8 such as a process chamber for fabricating semiconductor components, and comprises a secondary pump 9 of the molecular, turbomolecular, or hybrid type, a primary pump 10 adapted to deliver to an outlet 11 at atmospheric pressure, a first pipe 12 having an inlet 13 connected to an outlet 14 of the vacuum enclosure 8 and an outlet 15 connected to a suction inlet 16 of the secondary pump 9, and an intermediate pipe 17 having an inlet 18 connected to a delivery outlet 19 of the secondary pump 9 and having an outlet 20 connected to a suction inlet 21 of the primary pump 10.

The apparatus has first control and adjustment means 22 adapted to control and adjust the total gas pressure of the mixture of gases in the vacuum enclosure 8.

In practice, the first control and adjustment means 22 may comprise means 23 for controlled injection of gas into the vacuum enclosure 8, and/or a regulation valve 24 interposed in the first pipe 12 and controlled by an enclosure pressure controller 25 as a function of measurement data relating to total pressure as produced by a pressure gauge 26 in the vacuum enclosure 8. The enclosure pressure controller 25 may be constituted, for example, by a microcontroller programmed to keep the total pressure in the vacuum enclosure 8 constant, as a function of a total pressure setpoint 27.

According to the invention, the apparatus further comprises second control and adjustment means 28 distinct from the first control and adjustment means 22, disposed downstream from the secondary pump 9, and acting on the delivery pressure from the secondary pump 9 into the intermediate pipe 17, over the range of pressures for which changes in pressure lead to perceptible selective variations in the pumping speeds of different gases in the mixture through the secondary pump 9. As a result, the pumping capacity of the secondary pump 9 is adapted selectively, thus making it possible to adjust the proportions of the gases in the gaseous mixture inside the vacuum enclosure 8.

In practice, the second control and adjustment means 28 can comprise regulation means 29 controlling the conductance of the intermediate pipe 17 under the control of a delivery pressure controller 30 which receives a delivery pressure setpoint 32 and outlet pressure data produced by a delivery pressure gauge 31 in the intermediate pipe 17.

Figure 2:
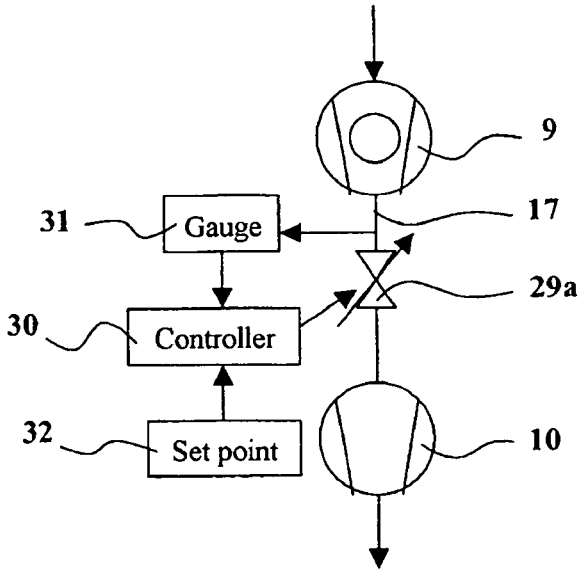
FIG. 2 shows an embodiment of the second control and adjustment means of the invention.
Figure 3:
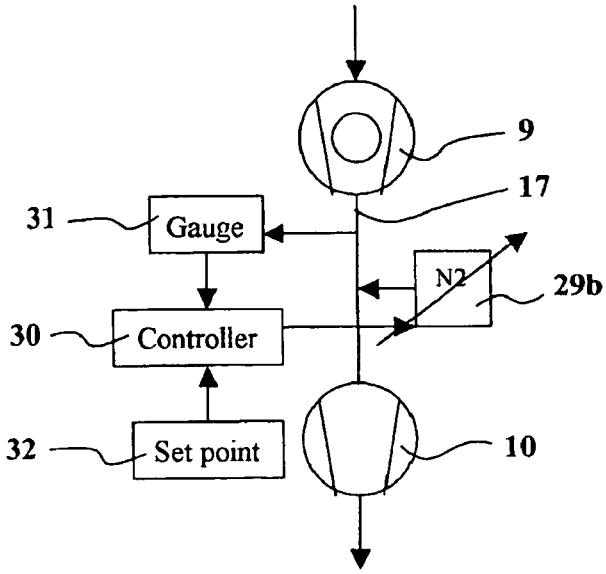
FIG. 3 shows another embodiment of the second control and adjustment means of the invention.
Figure 4:
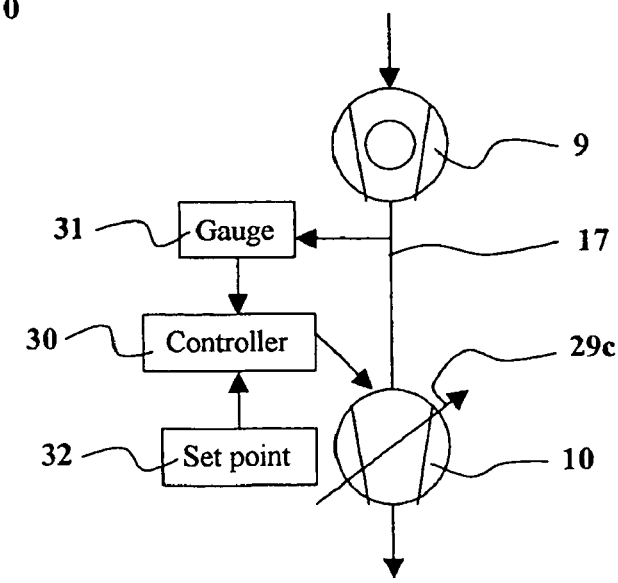
FIG. 4 shows another embodiment of the second control and adjustment means of the invention.

FIGS. 2, 3, and 4 show three embodiments of the second control and adjustment means. In each case, there is the secondary pump 9, the primary pump 10, the delivery pressure sensor 31, the delivery pressure controller 30, and a delivery pressure setpoint 32.

In FIG. 2, the regulation means is a regulation valve **29*a* interposed in the intermediate pipe 17**.

In FIG. 3, the regulation means is a gas injection device **29*b* for injecting an inert gas such as nitrogen into the intermediate pipe 17**.

In FIG. 4, the regulation means is speed control means **29*c* for varying the speed of rotation of the primary pump 10**.

Each of these embodiments of the regulation means 29 can be used on its own or in combination with one or two other regulation means.

In the embodiment of FIG. 1, there is also provided a control unit 33 which generates the delivery pressure setpoint 32. The control unit 33 thus controls the second control and adjustment means 28, e.g. in application of a specific program recorded in a memory and serving to adapt selectively the pumping capacity of the secondary pump 9 to the various successive steps in a treatment process taking place in the vacuum enclosure 8.

Assume for example that the treatment process in the vacuum enclosure 8 comprises two successive treatment steps with two different gas mixtures, and that in the first step it is necessary essentially to evacuate heavy gases, while in the second step it is necessary essentially to evacuate light gases, then the control unit 33 can generate a high delivery pressure setpoint 32 during the first step and a relatively lower delivery pressure setpoint 32 for the second step.

Variation in the delivery pressure setpoint 32 can be adapted to each treatment process, seeking to optimize for each step the selected pumping capacity of the secondary pump 9 so as to optimize the treatment process.

Figure 5:
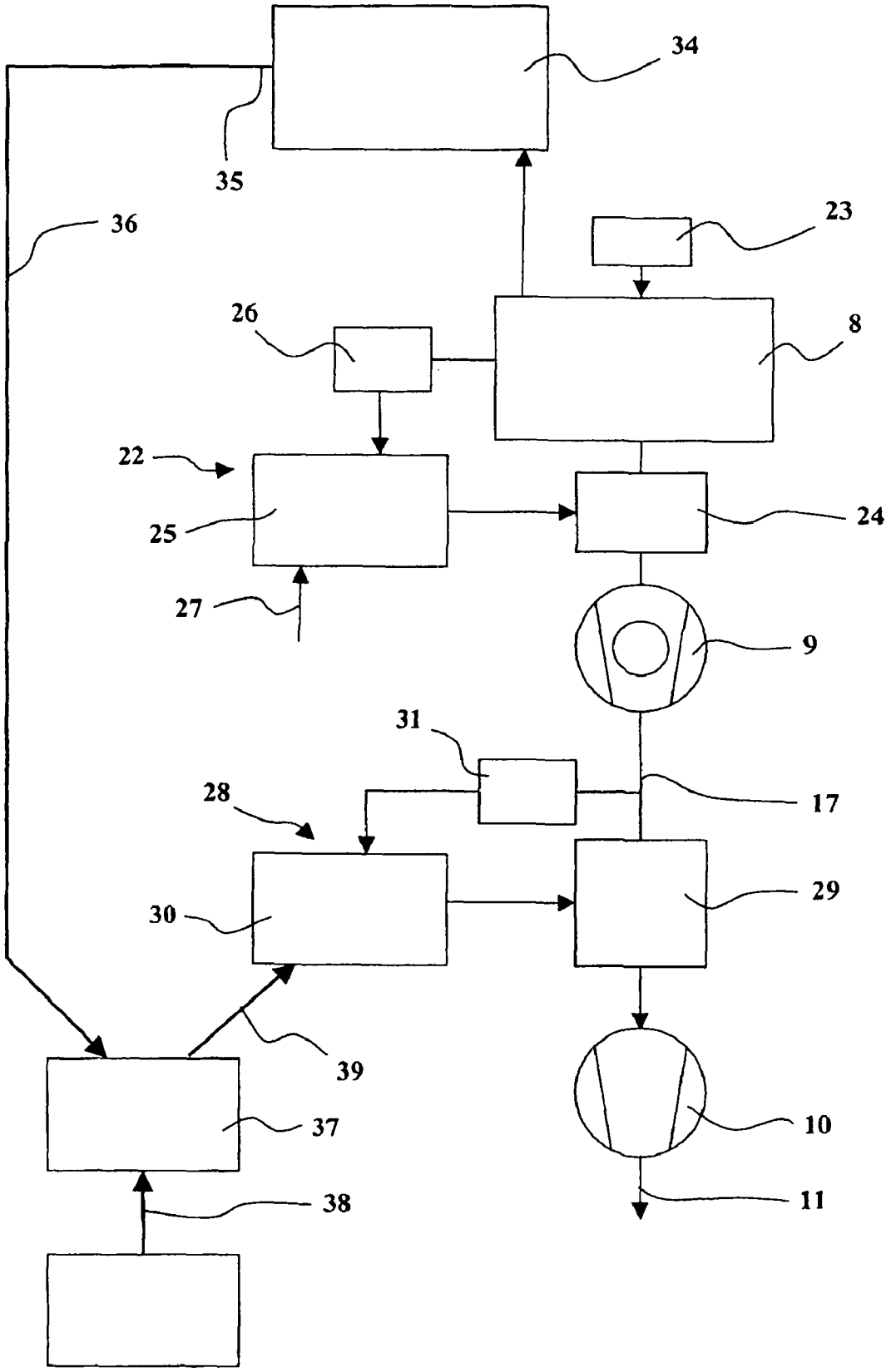
FIG. 5 is a diagram showing apparatus in a second embodiment of the invention.

Reference is now made to FIG. 5 which shows a further improved second embodiment of apparatus of the invention.

In this second embodiment, there are the same essential elements as in the first embodiment shown in FIG. 1, and these elements are identified by the same numerical references. That is why these same means are not described again in detail.

The difference lies in the fact that the apparatus further comprises means for regulating the partial pressures of the gases in the vacuum enclosure 8.

To do this, partial pressure sensors 34 are provided that are suitable for determining the partial pressures of one or more gases in the mixture of gases in the vacuum enclosure 8, and to produce partial pressure data at their outputs 35 for application via a line 36 to a partial pressure controller 37.

There is also provided a partial pressure controller 37 that does receive the partial pressure data produced by the partial pressure sensors 34, that compares this data with partial pressure setpoints 38, and that delivers an output signal on its output 39 for controlling the second control and adjustment means 28 in order to selectively adapt the pumping capacity of the secondary pump 9.

In practice, the partial pressure controller 37 compares the measured partial pressure data and the partial pressure setpoint data 38, searching for differences between the measured gas proportions and the proportions corresponding to the partial pressure setpoints 38. Thereafter, in the presence of a difference, the partial pressure controller 37 generates on its output 39 a delivery pressure signal for controlling the regulation means 29 to act on the delivery pressure of the secondary pump 9 so as to selectively adapt the pumping capacity of the secondary pump 9 in the direction appropriate for reducing the difference between the measured gas proportions and the proportions corresponding to the partial pressure setpoints 38.

For example, for a mixture of two gases present in the vacuum enclosure 8 at respective measured partial pressures P1 and P2, the partial pressure sensors 34 communicate the measurements P1 and P2 to the partial pressure controller 37 which takes the ratio P1/P2. The partial pressure controller also receives from the partial pressure setpoint 38 the partial pressures P10 and P20 for the same gases and can calculate the ratio P10/P20. The partial pressure controller 37 then determines the difference between the ratios P1/P2 and P10/P20, and deduces therefrom, as a function of data previously recorded in its memory, whether the delivery pressure into the intermediate pipe 17 from the delivery output of the secondary pump 9 needs to be increased or decreased in order to reduce this difference.

The partial pressure controller 37 thus generates on its output 39 a delivery pressure setpoint. The delivery pressure setpoint 31 measures the delivery pressure in the intermediate pipe 17 and generates delivery pressure measurement data. The delivery pressure controller 30 receives the delivery pressure setpoint and the measured delivery pressure data, and controls the regulation means 29 so as to reduce the difference between the delivery pressure setpoint and the measured delivery pressure data.

Alternatively, the partial pressure controller can control the regulation means 29 directly so as to reduce the difference between a partial pressure setpoint and the measured partial pressure.

The apparatus of the invention can find a variety of applications, during the steps of processes in which there is a need to adapt the proportions of gases in a mixture of gases.

By way of example, this is advantageous during the procedure for controlled evacuation of a vacuum enclosure, in particular towards the end of the evacuation operation: under such circumstances, it is advantageous to pump out more strongly any moisture present in the mixture, and this can be done by acting on the delivery pressure of the secondary pump so as to increase the pumping of moisture.

In another example, during certain process steps, it can be advantageous to keep the partial pressure of at least one gas in the vacuum enclosure constant. This can be done by acting on the selective pumping capacity of the secondary pump in order to keep this partial pressure constant.

The possibility of acting on the selective pumping capacity of the secondary pump can also be useful when it is desired to compensate for drift in a system for pumping gas from a vacuum enclosure.

Another advantageous application lies in compensating for possible variations in the pumping characteristics of a secondary pump, either because of the pump aging over time, or because of matter becoming deposited progressively on the walls of the pump, or indeed because one pump has been replaced by another.

In an application to dry etching processes for fabricating semiconductors and micro-electromechanical systems (MEMS), it is possible advantageously to evacuate in preferential manner the heavy gases that come from etching reactions by increasing the delivery pressure from the secondary pump. This produces a significant increase in the speed of etching.

The system for controlling the delivery pressure from the secondary pump can be operated in an open loop, i.e. without servo-control, or in a closed loop by servo-controlling the pressure given by a sensor situated on the vacuum line at the outlet from the secondary pump.

Servo-control may also be performed in overall manner by measuring the partial pressures within the vacuum enclosure, e.g. using mass spectrometers, or optical spectrometers, and acting on the outlet pressure control element so as to obtain the desired concentrations in the vacuum enclosure.

When the apparatus is used in association with a polysilicon etching process, it enables etching speed to be controlled.

The partial pressure setpoints for the gases may result from real time measurements of various parameters of a process that is taking place within the vacuum enclosure, or from indicators in deferred time. The deferred time indicators may be measurements associated with optimizing the process, for example etching speed, measuring contamination, drift in a process parameter in the event of an indicator associated with reconditioning.

In apparatus of the invention, action is taken on the delivery pressure of the secondary pump 9 over the range of pressures for which such modifications lead to significant variations in the pumping speeds of the gases in a manner that is selective depending on the nature of the gases, as a result of the intrinsic characteristics of turbomolecular, molecular, or hybrid pumps.

By applying partial pumping speed variations, the apparatus also leads to a variation in the total pumping speed from the vacuum enclosure, and thus might vary the total pressure in the vacuum enclosure.

The apparatus thus acts simultaneously on the means for regulating the suction pressure upstream from the secondary pump 9 in order to readjust the total pressure in the vacuum enclosure so as to keep it constant.

This makes it possible to completely dissociate controlling the total pressure in the vacuum enclosure as a function of the total pressure setpoint 27 from controlling the partial pressures within the same vacuum enclosure 8 based on the partial pressure setpoints 38.

The present invention is not limited to the embodiments described explicitly above, but includes any variant or generalizations that are within the competence of the person skilled in the art.

What is claimed is:

1. An apparatus for establishing and controlling an appropriate low pressure gas mixture, including at least first and second gases, in a vacuum enclosure, the apparatus comprising:

at least one secondary pump of a molecular, turbomolecular, or hybrid type;

at least one primary pump adapted to deliver to atmospheric pressure;

a first pipe having an inlet connected to an outlet of the vacuum enclosure and an outlet connected to a suction inlet of the secondary pump;

an intermediate pipe having an inlet connected to a delivery outlet of the secondary pump and an outlet connected to a suction inlet of the primary pump;

first control and adjustment means, disposed upstream from the at least one secondary pump, adapted to controlling and adjusting the total gas pressure of the mixture of gases in the vacuum enclosure as a function of a total pressure setpoint;

second control and adjustment means distinct from the first control and adjustment means, disposed downstream from the secondary pump, for acting on the delivery pressure from the secondary pump in the range of pressures in which changes of the delivery pressure lead to variations in pumping capacity of the secondary pump with significant variations in the selective pumping speeds of different gases of the mixture and for acting on the delivery pressure in response to a delivery pressure setpoint so as to adapt the pumping capacity of the secondary pump selectively, thereby adjusting the pumping speeds of the different gases in the mixture of gases in the vacuum enclosure; and a control unit for controlling the second control and adjustment means in application of a specific program for adapting the pumping capacity of the secondary pump selectively to the various successive steps of a treatment process taking place in the vacuum enclosure, said control unit including means for generating a predetermined setpoint for said deliver pressure, at a specified step in the treatment process for which the second gas is to be evacuated from the vacuum chamber at a speed higher than the first gas is evacuated, and for providing the predetermined setpoint to the second control and adjustment means, said predetermined setpoint selected to cause the secondary pump to pump the first gas at a first selected speed and the second gas at a second selected speed greater than the first speed, thereby evacuating the second gas at a higher speed, as specified for the specified step in the treatment process, and partial pressure sensors determining partial pressure or one or more gases in the enclosure and operatively connected to said control unit, thereby controlling speed of removal of the first and second gases in the vacuum enclosure at the specified step in the treatment process by controlling the pumping speed of the secondary pump to favor pumping at least one of the gases, whereby said apparatus exercises control over both the overall gas pressure in the vacuum enclosure and the proportions of gases in the gaseous mixture of the vacuum enclosure.

2. Apparatus according to claim 1, in which the first control and adjustment means are disposed upstream from the secondary pump, and comprise a regulation valve interposed in the first pipe and/or means for controlled injection of gas into the vacuum enclosure.

3. Apparatus according to claim 1, in which the second control and adjustment means comprise a regulation valve interposed in the intermediate pipe.

4. Apparatus according to claim 1, in which the second control and adjustment means comprise a gas injection device for injecting an inert gas into the intermediate pipe.

5. Apparatus according to claim 1, in which the second control and adjustment means comprise speed control means for controlling the speed of the primary pump.

6. An apparatus for establishing and controlling an appropriate low pressure gas mixture in a vacuum enclosure comprising:

at least one secondary pump of a molecular, turbomolecular, or hybrid type;

at least one primary pump adapted to deliver to atmospheric pressure;

a first pipe having an inlet connected to an outlet of the vacuum enclosure and an outlet connected to a suction inlet of the secondary pump;

an intermediate pipe having an inlet connected to a delivery outlet of the secondary pump and an outlet connected to a suction inlet of the primary pump;

first control and adjustment means, disposed upstream from the at least one secondary pump, adapted to controlling and adjusting the total gas pressure of the mixture of gases in the vacuum enclosure as a function of a total pressure setpoint, second control and adjustment means distinct from the first control and adjustment means, disposed downstream from the secondary pump; and partial pressure sensors suitable for determining the partial pressure(s) of one or more gases in the mixture of gases in the vacuum enclosure, and for producing partial pressure data; the partial pressure sensors operatively connected to a partial pressure controller, the partial pressure controller receiving the partial pressure data produced by the partial pressure sensors, comparing said data with partial pressure setpoints, searching for differences between the measured proportions of the gases and the proportions corresponding to the partial pressure setpoints, and generating an output signal controlling the second control and adjustment means to adapt the pumping capacity of the secondary pump selectively in the direction that reduces the difference between the measured proportions of the gases and the proportions corresponding to the partial pressure setpoints.

7. Apparatus according to claim 6, in which: the partial pressure controller generates on its output a delivery pressure setpoint; a delivery pressure sensor measures the delivery pressure in the intermediate pipe and generates delivery pressure measurement data; and a delivery pressure controller receives the delivery pressure setpoint and the delivery pressure data, and controls a delivery pressure regulation means to reduce the difference between the delivery pressure setpoint and the measured delivery pressure data.

8. A method of establishing and controlling an appropriate low pressure mixture of gases in a vacuum enclosure using apparatus according to claim 1, by acting on the delivery pressure of the secondary pump to adapt its pumping capacity selectively, thereby adjusting the proportions of the gases in the gas mixture.

9. A method according to claim 8, in which action is taken on the delivery pressure by modifying the conduction of the intermediate pipe.

10. A method according to claim 8, in which action is taken on the delivery pressure by injecting an inert gas into the intermediate pipe.

11. A method according to claim 8, in which action is taken on the delivery pressure by modifying the speed of the primary pump.

12. A method according to claim 8, in which action is taken on the delivery pressure of the secondary pump as a function of successive steps in a treatment process taking place in the vacuum enclosure.

13. A method according to claim 8, in which action is taken on the delivery pressure of the secondary pump in the direction appropriate for increasing the pumping of moisture during a process of controlled evacuation of the vacuum enclosure.

14. A method according to claim 8, in which action is taken on the delivery pressure of the secondary pump in the direction appropriate for keeping the partial pressure of at least one gas in the vacuum enclosure constant.

15. A method for controlling simultaneously both the overall pressure in an enclosure and the composition of the gas mixture contained in the enclosure comprising the steps of:

providing a primary pump adapted to deliver to atmospheric pressure;

providing a secondary pump of a molecular, turbomolecular, or hybrid type;

connecting the secondary pump to the enclosure;

connecting the primary pump to the secondary pump;

providing a first control and adjustment device upstream from the secondary pump; and providing a second control and adjustment device downstream from the secondary pump, the second control and adjustment device including partial pressure sensors determining partial pressures of one or more gases in the enclosure and operatively connected to a control unit, whereby the proportions of gases in the gaseous mixture of the enclosure is selectively controlled via the control unit.

16. A method according to claim 15, further comprising the step of compensating for variations in the pumping characteristics of the secondary pump.

17. A method according to claim 15, further comprising the step of compensating for drift while pumping gas from the enclosure.

18. A method according to claim 15, further comprising the step of increasing a delivery pressure of the secondary pump, wherein the speed of a dry etching process is increased by increasing the delivery pressure.

19. A method according to claim 15, further comprising the step of controlling the quality of chemical vapor deposition (CVD) using the delivery pressure of the secondary pump.

20. An apparatus for a establishing and controlling a predetermined gaseous mixture in a vacuum enclosure comprising:

a primary pump adapted to deliver to atmospheric pressure;

a turbomolecular pump connected to the primary pump;

a first control and adjustment device, adapted and constructed to control and adjust the total gas pressure of the mixture of gases in the vacuum enclosure, including at least one of a controlled gas injection device connected to the vacuum enclosure and a regulator connected to the turbomolecular pump;

a second control and adjustment device connected to the primary pump downstream from the turbomolecular pump, whereby complete control over both the overall gas pressure in the enclosure and the proportions of gases in the gaseous mixture of the enclosure is maintained by selectively adapting the pumping capacity of the turbomolecular pump with the second control and adjustment device in accordance with pressure setpoints determined during a treatment process.

* * * * *